US008763889B2

(12) United States Patent
Weissbrod

(10) Patent No.: US 8,763,889 B2
(45) Date of Patent: Jul. 1, 2014

(54) STACKABLE CARTON

(75) Inventor: Paul A. Weissbrod, South Euclid, OH (US)

(73) Assignee: Lincoln Global, Inc., City of Industry, CA (US)

( * ) Notice: Subject to any disclaimer, the term of this patent is extended or adjusted under 35 U.S.C. 154(b) by 320 days.

(21) Appl. No.: 13/173,482

(22) Filed: Jun. 30, 2011

(65) Prior Publication Data

US 2013/0001285 A1 Jan. 3, 2013

(51) Int. Cl.

*B65D 5/46* (2006.01)
*B65D 85/00* (2006.01)
*B65D 25/54* (2006.01)

(52) U.S. Cl.

USPC ..... 229/117.13; 229/117.15; 229/122; 229/162.1; 206/459.5

(58) Field of Classification Search

USPC ..... 229/117.14, 117.15, 916, 919, 150, 229/125.12, 117.09, 117.17; 206/144, 413, 206/510

See application file for complete search history.

(56) References Cited

U.S. PATENT DOCUMENTS

| | | | | |
|---|---|---|---|---|
| 1,922,605 | A | 8/1933 | Spear | |
| 1,976,530 | A | 10/1934 | Verhoven | |
| 2,917,220 | A | 12/1959 | Bostock | |
| 3,133,632 | A | 5/1964 | Goldstein | |
| 3,235,148 | A | 2/1966 | Honhart | |
| 3,385,430 | A | 5/1968 | Benzon-Petersen | |
| 4,039,119 | A | 8/1977 | Crane | |
| 4,497,407 | A | 2/1985 | Stager | |
| 4,707,011 | A | 11/1987 | McKim, Jr. | |
| 4,799,620 | A | 1/1989 | Vilella | |
| 4,812,054 | A | 3/1989 | Kirkendall | |
| 4,819,795 | A | 4/1989 | Swaney | |
| 5,115,965 | A | 5/1992 | Girona Alepuz | |
| 5,269,454 | A | 12/1993 | Perazzo | |
| 5,779,048 | A * | 7/1998 | Dunn | 206/449 |
| 5,871,102 | A | 2/1999 | Lambert | |
| 7,380,702 | B2 * | 6/2008 | Oddo | 229/104 |
| D590,710 | S | 4/2009 | Mittelstaedt | |
| 7,780,004 | B2 | 8/2010 | Carlozzi et al. | |

(Continued)

FOREIGN PATENT DOCUMENTS

DE 4218405 A 12/1993

OTHER PUBLICATIONS

Firepower 1440G0197 low Hydrogen 7018 AC/DC Arc Welding Electrode, Jan. 6, 2011, http://www.google.com/products/catalog?q=welding+(rod+OR+electrode+OR+stick)&hl=en&rls=com.microsoft:en-us&rlz=1I7ADFA_en&wrapid=tlif12943420049471&um=1&ie=UTF-8&cid=7158076416612673162&ei=EBgmTbTnPNyr nAfBtsjcAQ&sa=X&oi=product_catalog_result&ct=result&resnum=l&ved=0CGoQ8wlwADgK#.

(Continued)

*Primary Examiner* — Gary Elkins
*Assistant Examiner* — Christopher Demeree
(74) *Attorney, Agent, or Firm* — Shannon V. McCue; Hahn Loeser & Parks LLP

(57) ABSTRACT

A container and carton assembly comprising a container including a first portion and having a plurality of items that longitudinally extend between a first end and a second end of the container. The carton assembly includes at least two handles and means for securing said at least two handles about opposing sides of the container where the at least two handles extend above a horizontal plane of the container and where at least the at least two handles form an offset stacking index.

11 Claims, 12 Drawing Sheets

(56) References Cited

U.S. PATENT DOCUMENTS

| | | | | |
|---|---|---|---|---|
| 7,854,371 | B2 * | 12/2010 | Mittelstaedt | 229/117.16 |
| 2004/0099719 | A1 * | 5/2004 | Shadrach, III | 229/116.1 |
| 2009/0212097 | A1 | 8/2009 | Fredrich et al. | |
| 2010/0251672 | A1 | 10/2010 | Weissbrod | |
| 2010/0308096 | A1 | 12/2010 | Carlozzi et al. | |

OTHER PUBLICATIONS

Packaging Trays and Tubes, Jan. 6, 2011, Oram Packaging Industries, http://indiamart.com/rampackagingindustries/packaging-trays-and-tubes.html.

* cited by examiner

STACKABLE CARTON

TECHNICAL FIELD

The invention described herein relates generally to stackable cartons for industrial materials.

BACKGROUND OF THE DISCLOSURE

Numerous types of consumable articles are packaged for display and sale to the consumer every day. Some articles are sold in containers arranged in a retail display and categorized by function or use in a particular application. It will be appreciated that the type of article sold may affect the kind of packaging needed to store and effectively display the article. Some articles are bundled together and packaged in rigid containers, which do not conform to the shape of the bundle. As a result, the articles tend to shift within the container when handled if the container is not tightly packed. One such type of article pertains to industrial consumables like, for example, welding rods used in a stick welding procedure.

Current packaging of such materials includes containers that are constructed with a generally flat bottom, which allow for movement between containers when stacked together. If the containers are not heavy, consumers frequently pick up the containers looking for information about a particular product needed for their application. When the containers are heavy, consumers or end-users at best may struggle with the containers when they look for product information. When heavy containers are placed back on the shelf or stand by an end-user, the containers may not be properly restacked resulting in a stack of offset containers. This leaves the display looking disjointed and unsightly, and reflects negatively on the manufacturer. In many instances, the containers slide and fall from the stack damaging the contents.

Accordingly, a need exists for a carton that packages the rigid container that includes means for stacking multiple cartons each having a container in a neat and repeatable order while providing easy access to the consumer. The embodiments of the subject invention provide a stackable carton and container that restrains longitudinal movement between stacked cartons each having a container and provides a means for carrying the carton and container, thereby obviating the aforementioned problems.

In view of the foregoing problems and shortcomings, the present application describes various cartons that can package containers to overcome these shortcomings.

SUMMARY OF THE DISCLOSURE

In accordance with the present invention, there is provided a carton and a container disposed within the carton comprising a plurality of items in the container, wherein the plurality of items longitudinally extend in the container. In addition, the carton includes a first pair of carton walls spaced apart by at least one carton wall and at least two handles extending above a horizontal plane of the container. The handles vertically extend from opposing ends of the carton, wherein the handles include apertures in the vertically extending handles and the apertures are above the horizontal plane. Further, the handles and the at least one carton wall form a stacking index and the horizontal plane is a top panel.

Also within the scope of the invention is an apparatus comprising a container having a plurality of electrodes that longitudinally extend between a first end and a second end of the container. Further including a means for securing at least two handles to opposing sides of the container, wherein the handles extend above at least a horizontal plane of the container, and wherein the means for securing at least two handles to opposing sides of the container form an offset stacking index.

Also within the scope of the invention is a container and carton assembly comprising a container including a top portion and having a plurality of electrodes that longitudinally extend between a first end and a second end of the container. In addition, the carton assembly includes at least two handles and means for securing the at least two handles about opposing sides of the container where the at least two handles extend above a horizontal plane of the container and where at least the at least two handles form an offset stacking nest.

Also within the scope of the invention is an apparatus comprising a pair of spaced-apart vertical carton sides and a bottom carton side connecting the sides, each vertical side having at least one laterally-extending tab on each end of the vertical sides. Further, the apparatus includes a pair of handles on each end of the spaced-apart vertical sides, each handle having a pair of essentially parallel side edges, a top and a bottom side edge, each of the vertical side edges having at least one slot positioned inward from the vertical side edges and in mating alignment with the at least one laterally-extending tab These and other objects of this invention will be evident when viewed in light of the drawings, detailed description and appended claims.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof, and wherein.

DETAILED DESCRIPTION OF THE DRAWINGS

The best mode for carrying out the invention will now be described for the purposes of illustrating the best mode known to the applicant at the time of the filing of this patent application. The examples and figures are illustrative only and not meant to limit the invention, which is measured by the scope and spirit of the claims.

Figure 1B:
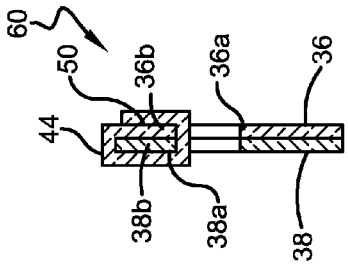
FIG. 1*b* is a cross-sectional view of a portion of the handle illustrated in FIG. 1*a* taken along line 1*b*-1*b* shown in FIG. 1*a;*
Figure 1A:
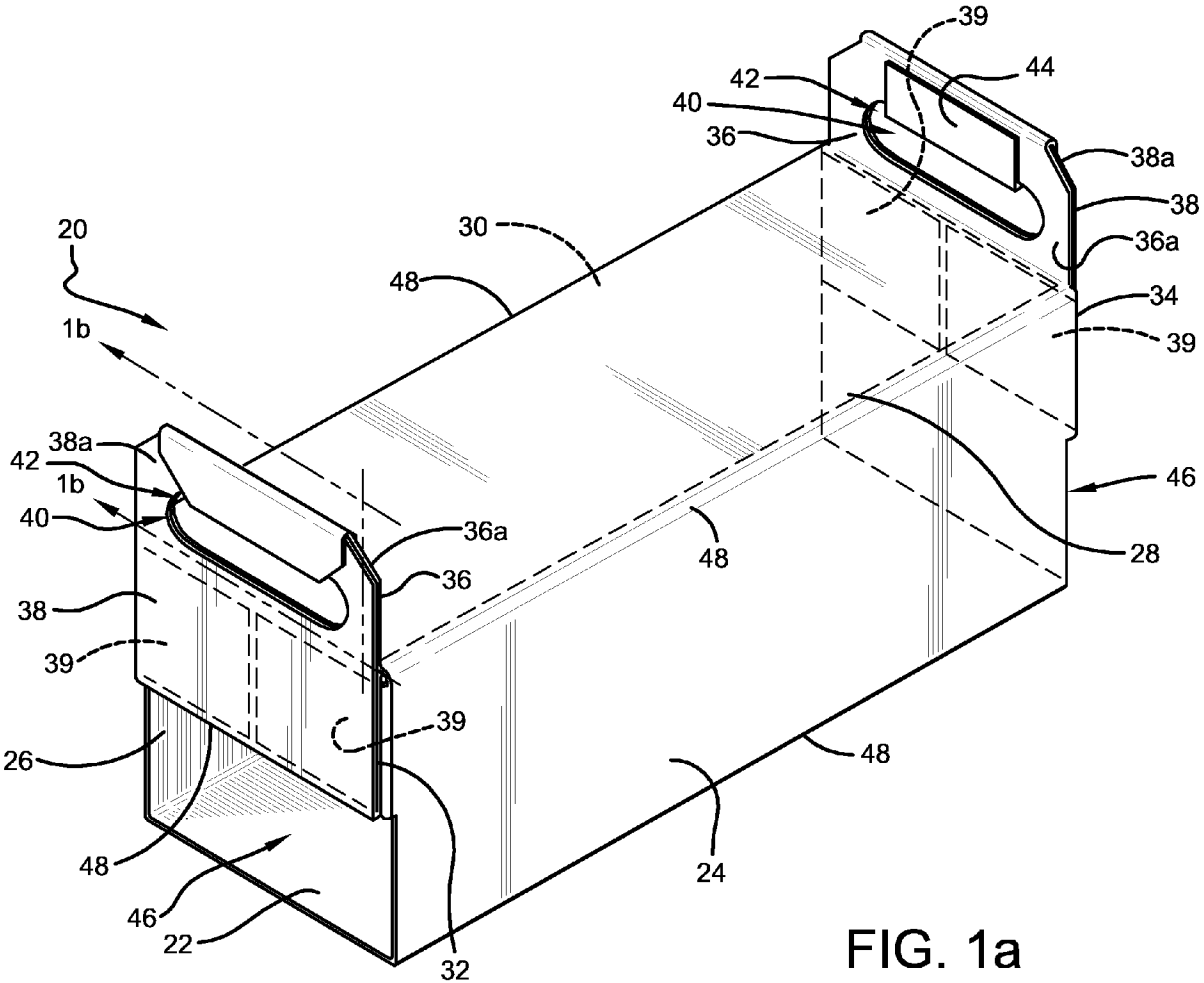
FIG. 1*a* is a top perspective view of an assembled carton with underlying flaps and/or panels illustrated by ghost lines.

Referring now to the drawings wherein the showings are for purposes of illustrating the preferred embodiment of the invention only and not for purposes of limiting the same, as illustrated in FIG. 1*a*, shows a carton depicted generally at 20 made from a flat or blank, as discussed below in FIG. 4. Carton 20 may be configured to hold a container (discussed below) so the container and carton 20 may be stacked in a retail display. Carton 20 may facilitate placement and removal of the carton holding the container from the retail display by an end-user and may facilitate carrying because handles (discussed below) more evenly distribute the carton and container weight. In a preferred embodiment, carton 20 is made from fibrous materials, e.g., cardboard and other paper materials, polymer substances, or both fibrous and polymer materials, recognizing that other materials of construction are within the scope of this invention.

In the illustrated embodiment, carton 20 and flat 70 (see FIG. 4) include bottom panel 22, sidewall panels 24 and 26 extending upward from bottom panel 22, and top panels 28 and 30 (shown in ghost lines) laterally extending from sidewall panels 24 and 26. In addition, carton 20 includes end panels 32 and 34 extending downward from top panel 30, handles 38 upwardly extending from end panels 32 and 34, handles 36 upwardly extending from top panel 28 and extending upward above a horizontal plane of top panel 28, and lateral flaps 39. Flaps 39 extend inwardly from each longitudinal end of sidewall panels 24 and 26. In other words, a first pair of carton walls, e.g., the sidewall panels, are spaced apart by a second pair of carton walls, e.g., the bottom panel and the top panel. Alternatively, the end panels are spaced apart by the sidewalls or the bottom and/or top panels. In the illustrated embodiment, each panel may be fabricated from a single contiguously formed sheet of material, as illustrated in FIG. 4. In another embodiment, the carton may include a bottom panel, sidewall panels, top panels, end panels, and handles fabricated from multiple panel sections. In yet another embodiment, the carton includes at least one side panel, handles, and at least one of the following: a bottom panel, at least one top panel, and end panels. In another embodiment, the carton may not include end panels that extend at each end from each sidewall.

Each handle 36, 38 includes an aperture disposed therein, namely 42, 40 respectively. In addition, handle 36 includes handle reinforcement 44 that extends upward from upper portion 36*a*. Handles 36 and 38 extend vertically above a horizontal plane of uppermost top panel 28 and/or 30 to facilitate handling and carrying of the container packaged in carton 20, e.g. heavy containers that are difficult to grip by hand or containers that are difficult to remove from a retail display. For example, heavy containers may include welding electrode containers that weigh forty pounds or more. The carton preferably includes at least two handles where at least one handle extends from at least one sidewall panel vertically above the uppermost horizontal plane of a top panel of the carton. Optionally, at least one handle vertically extends upward from another panel of the carton, e.g., the sidewalls or bottom panel.

Figure 4:
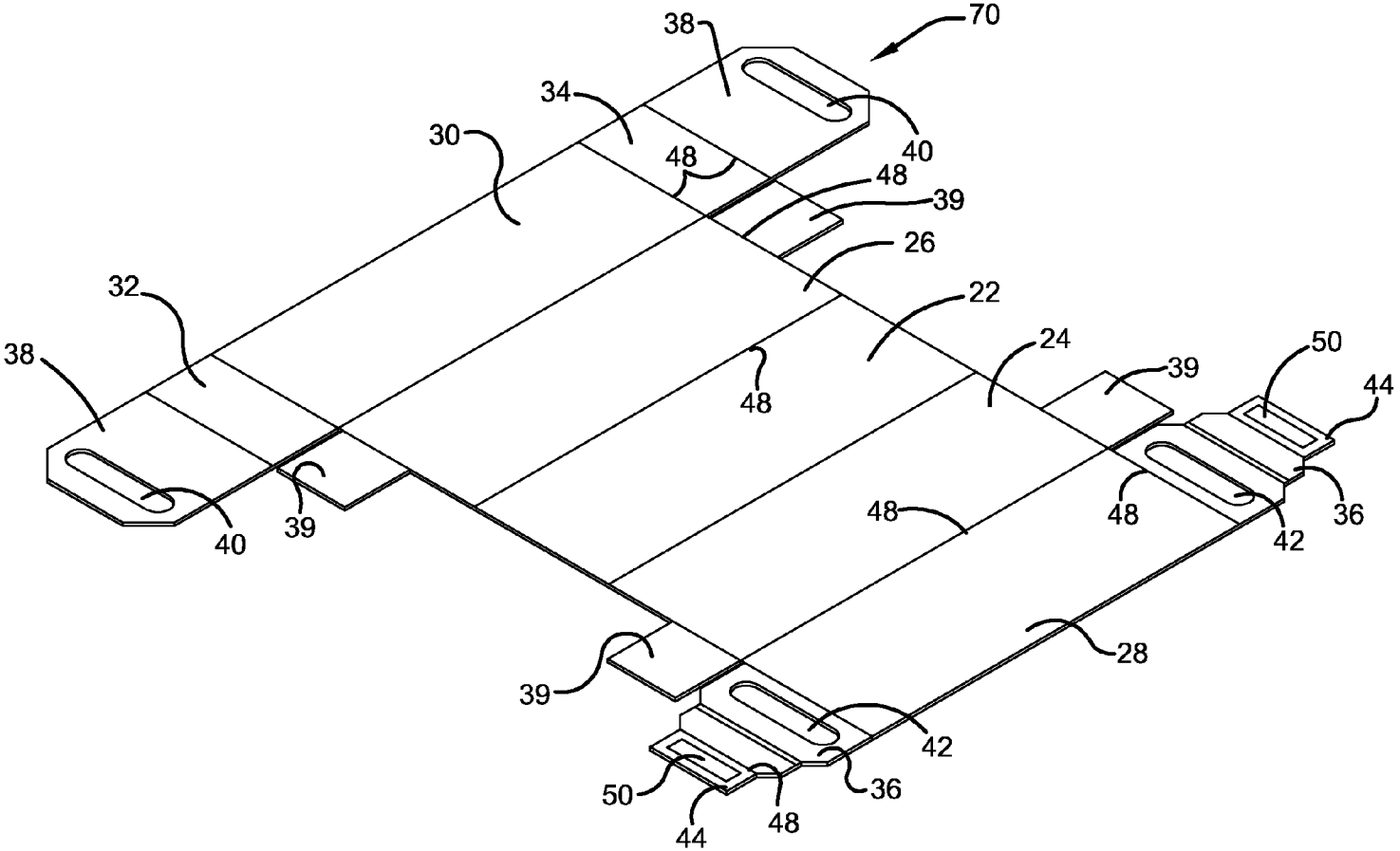
FIG. 4 is a top perspective view of a flat used to make the carton illustrated in FIG. 1*a;*

In the illustrated embodiment, handle reinforcements 44, contiguously formed as part of the single flat or blank, see FIG. 4, reinforce upper portion 36*a* and upper portion 38*a* of handles 36, 38 on each end of carton 20. Handle reinforcement 44 extends from upper portion 36*a* of handle 36, downwardly extends along each outer side of upper portion 38*a*, extends longitudinally through apertures 40 and 42, and upwardly extends along an inner side of upper portion 36*a* where handle reinforcement 44 is securedly connected to upper portion 36*a*. For example, handle reinforcement 44 is securedly connected to upper portion 36*a* by an adhesive or fastening means. In another embodiment, the handle reinforcement may wrap around each upper portion more than once or in another configuration or pattern to provide additional strength and/or cushioning. In yet another embodiment, the handle reinforcement may securedly connect to both inner and outer upper portions and/or to another panel of the carton. In the illustrated embodiment, carton 20 includes openings 46 on each end where a portion of the container (not shown) can be seen by the end-user and includes a plurality of preformed pleats 48 that facilitate forming carton 20 around a container. In another embodiment, the carton includes end panels that vertically extend between the bottom and top panels, therefore, the carton does not include openings on each end. In yet another embodiment, the carton includes a cutout in at least one panel so at least one other portion of the container can be seen by an end-user.

FIG. 1*b* illustrates a cross-sectional view of handles illustrated in FIG. 1*a* taken along a portion of line 1*b*-1*b* shown in FIG. 1*a*. Handles 36 and 38 are illustrated as having upper portions 36*a* and 38*a*, respectively, that are laterally adjacent to each other and a handle reinforcement 44 forming handle assembly 60 (discussed below in FIGS. 3*a*-3*c*). Handle reinforcement 44 extends vertically from upper portion 36*a*, laterally outward over upper portion 38*a*, downwardly extending adjacent to an outer side 38*b* of upper portion 38*a* and longitudinally through apertures 40 and 42 where reinforcement 44 extends upward along inner side 36*b* of upper portion 36*a*. Reinforcement 44 is securedly connected to inner side 36*b* of upper portion 36*a* by a fastening means 50. Fastening means 50 may include glue and/or tape adhesives and other mechanical fasteners know by one skilled in the art. In another embodiment, handle reinforcement includes a cutout and aperture that interlock to provide a fastening means. In yet another embodiment, handle reinforcement may be configured to be adjacent to at least one handle upper portion. In another embodiment, handle reinforcement may be configured to be adjacent to at least one of the following: upper handle portion, lower handle portion, top panel, and side panel, e.g., the handle reinforcement extends downward along the edges of the handle and securedly connects to the lower handle portion.

Figure 2:
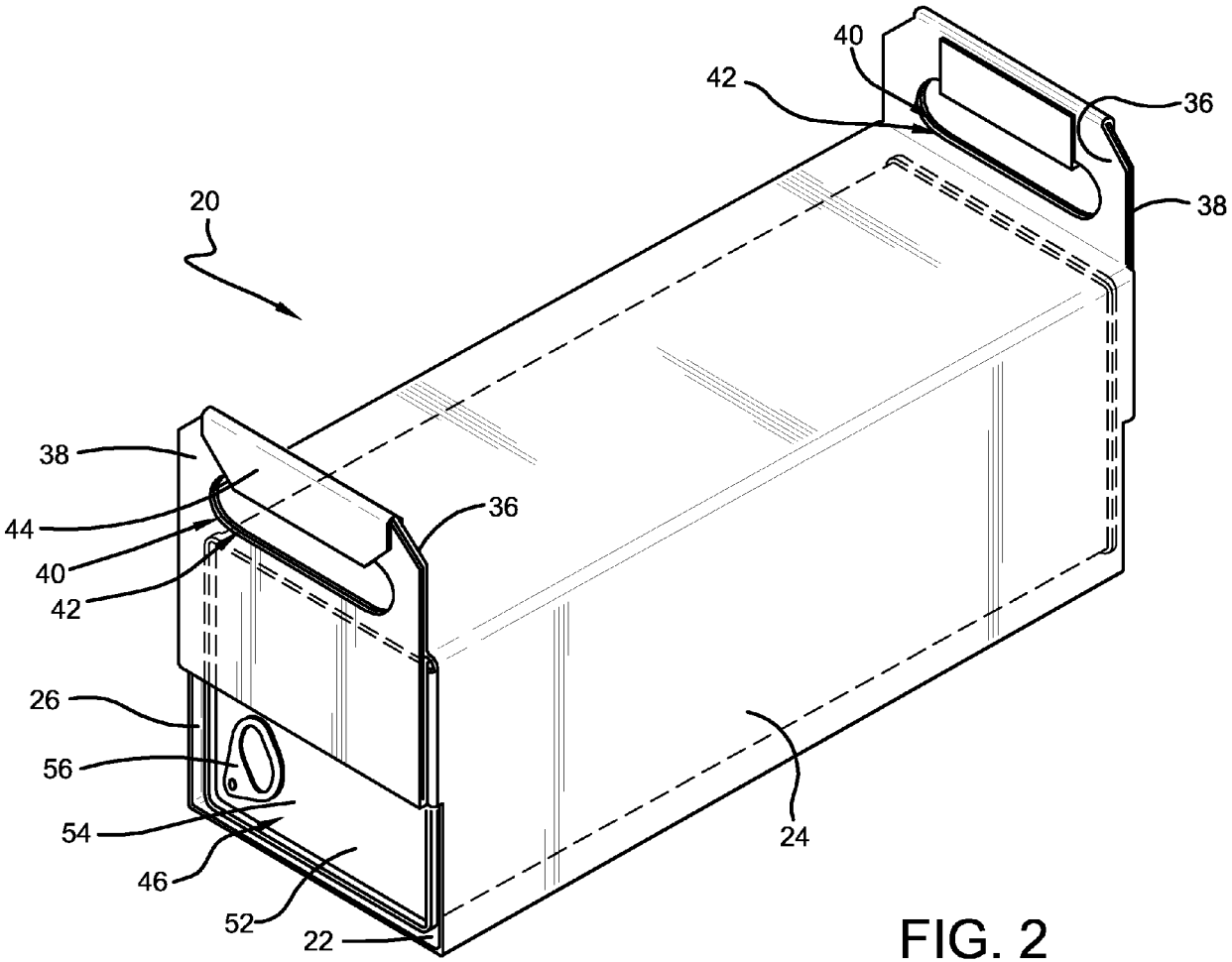
FIG. 2 is a top perspective view of a carton and container assembly positioned within the carton with hidden portions of the container assembly illustrated in ghost lines.

FIG. 2 illustrates carton 20 illustrated in FIG. 1*a* holding container 52. Container 52 may be used to package a plurality of articles (not shown) for storage and/or transportation purposes. As such, the walls of container 52 may be generally rigid or semi-rigid. In one embodiment, container 52 may be box like, e.g., rectangular receptacle constructed from metal or metal alloy. However, persons of ordinary skill in the art will readily understand the application of the embodiments of the subject invention to any size, shape and/or material used to construct container 52. By way of example, the figures depict a generally box-like container 52. Container 52 may be used to hold rod-like articles, such as for example, welding electrodes or rods (not shown). However, the type of articles contained by container 52 are not to be construed as being limited to welding materials or even rod shaped articles. Rather any type of article may be stored in container 52 as is appropriate for use with the embodiments of the subject invention. In the illustrated embodiment, container 52 may be hermetically sealed with pop-open cap 54 having removal tab 56. Carton 20 must be unassembled before the end-user can access articles inside container 52, ensuring the end-user sees indicia, e.g., product, safety, warning information, marketing, operating instructions, material specifications, and material safety data sheets, located on container 52 or packaged inside carton 20 before accessing an article from container 52. In another embodiment, the carton has indicia on an outside surface or on an inside surface.

In the illustrated embodiment, handles 36 and 38 have apertures 42 and 40, respectively, that are vertically positioned above top panels 28 and 30. In another embodiment, the handles have at least a handle portion, other than an aperture, that is vertically above the horizontal plane of the uppermost top panel of the carton or top of a container to facilitate handling of the carton by the end-user. In the illustrated embodiment, handles 36 and 38 support the load from the combined weight of carton 20 and container 52. In another embodiment, the handles optionally extend from the sidewalls or some other panel, still retaining the characteristic of having apertures extending above a container and the top uppermost panels of the carton.

Figure 3A:
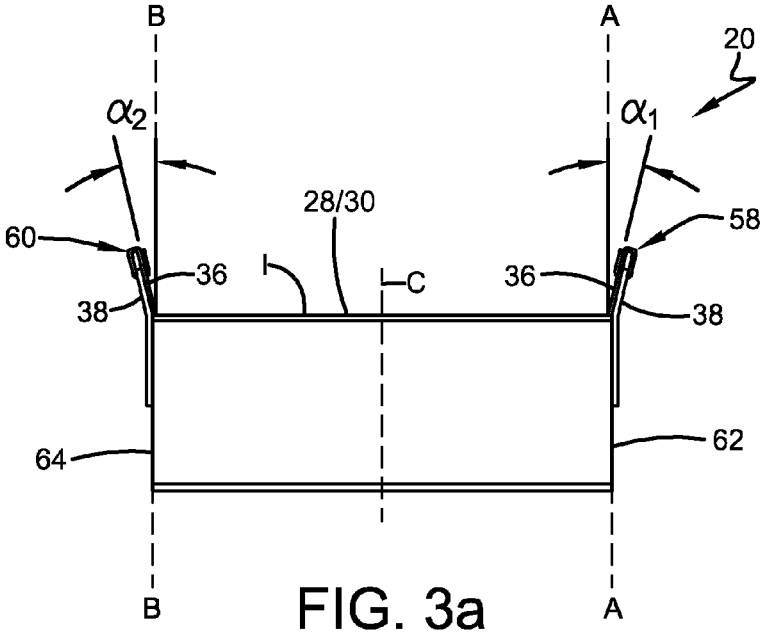
FIG. 3*a* is a side view of the carton illustrated in FIG. 1*a* illustrating the offset handles.
Figure 3B:
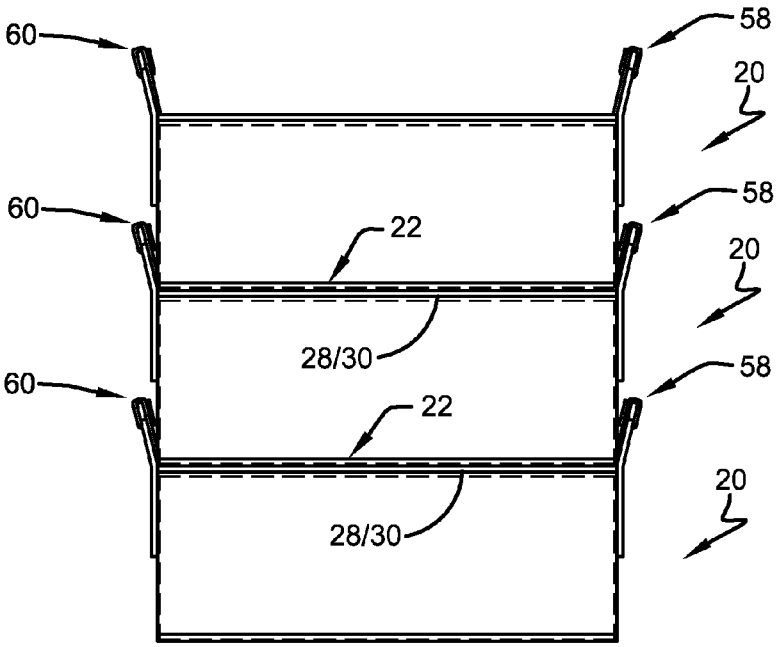
FIG. 3*b* is a side view of three cartons of FIG. 1*a* stacked in a vertical arrangement.
Figure 3C:
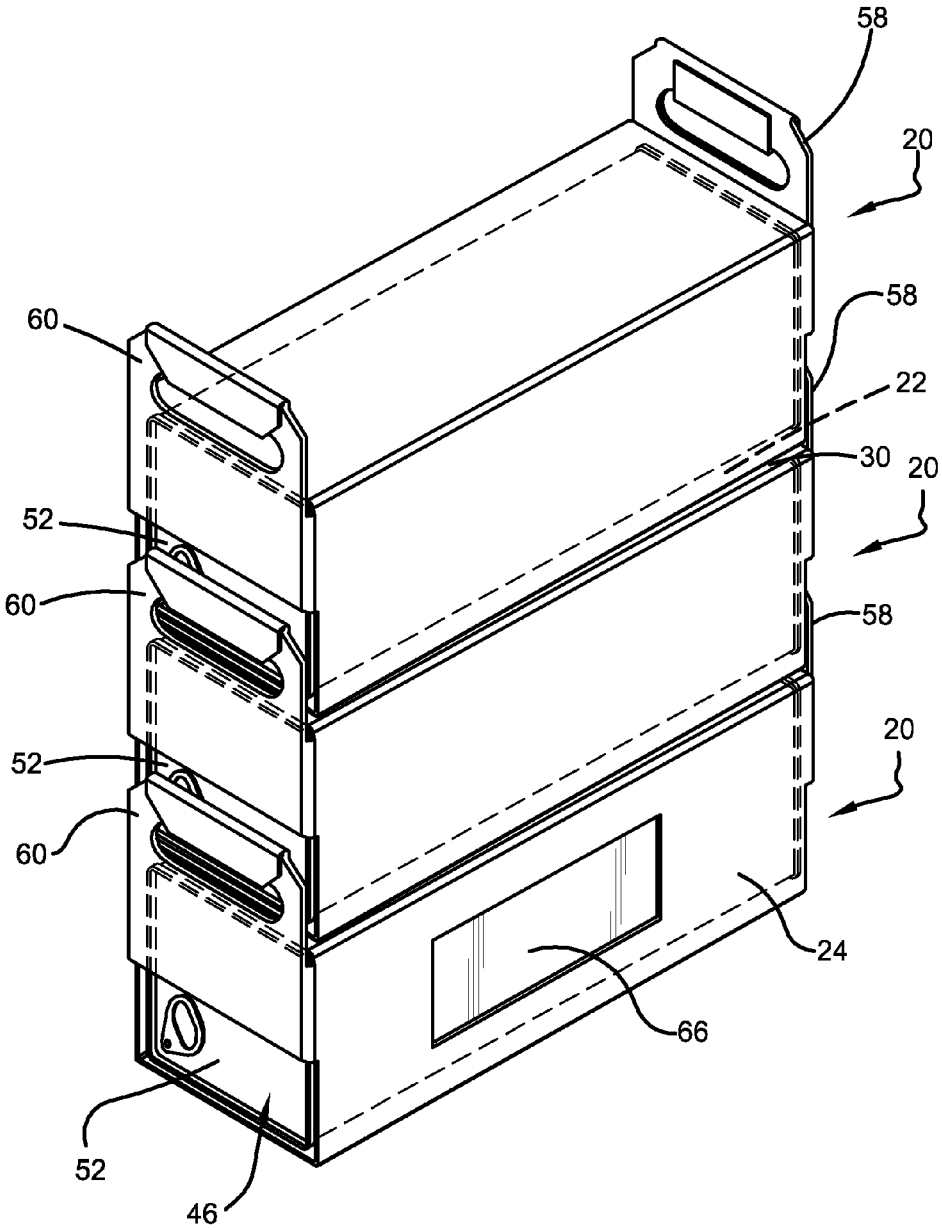
FIG. 3*c* is a top perspective view of the three stacked cartons illustrated in FIG. 3*b* further illustrating a cut-out in one side panel.

FIG. 3*a* illustrates a side view of carton 20, illustrated in FIGS. 1*a* and 2. Carton 20 includes handles 36 and 38 at each end, assembled together to form first handle assembly 58 and second handle assembly 60. First handle assembly 58 and second handle assembly 60 tilt away from first end 62 and second end 64, respectively, of carton 20. In other words, first handle assembly 58 is at first angle $\alpha_1$ relative to plane A that is essentially parallel with first end 62. Further, second handle assembly 60 is at second angle $\alpha_2$ relative to plane B that is essentially parallel with second end 64. First angle $\alpha_1$ and second angle $\alpha_2$ may independently be at an angle between zero and sixty degrees and first and second handle assemblies 58 and 60 can be adjustably tilted about this angle range. In the illustrated embodiment, first and second handle assemblies 58 and 60 and top panels 28 and/or 30 form an index I, locator, or a nest that releasably receives bottom panel 22 of another carton to facilitate vertical stacking of multiple cartons, as illustrated in FIG. 3*b*. FIG. 3*c* further illustrates a perspective view of the cartons 20 illustrated in FIG. 3*b* where each carton 20 contains container 52 that may be seen by a person through opening 46. In the illustrated embodiment, carton 20 includes at least one cutout 66 in at least one panel or portion of carton 20, preferably a side panel. For example, in the illustrated embodiment, carton 20 includes rectangular cutout 66 in sidewall panel 24. Similar to the openings on each end, the at least one cutout in the panel or portion of the carton allows the end-user to see indicia that may be on the outside surface of the container.

FIG. 4 illustrates a perspective view of flat or blank 70 that forms the carton (discussed above). Blank 70 is generally planar and a contiguous piece of material that includes a plurality of panels that are configured and preferably scored to form the assembled carton. Specifically, blank 70 includes bottom panel 22, sidewall panels 24 and 26, top panels 28 and 30, end panels 32 and 34, and handles 36 and 38. Blank 70 includes optional panels 39 or lateral end flaps extending from sidewalls 24 and 26 that provide additional reinforcement for end panels 32 and 34. Blank 70 includes a plurality of pleats 48 or scores that facilitate forming carton 20, as discussed above, and fastening means 50. Fastening means may include at least one of the following: glue, tape, Velcro, adhesive (permanent, removable, or pressure-sensitive), and the like. In another embodiment, the blank includes more or less panels than illustrated in FIG. 4. In yet another embodiment, the blank may include more than one contiguous piece and/or may include non-planar panels. In another embodiment, the blank does not include any fastening means.

Figure 5:
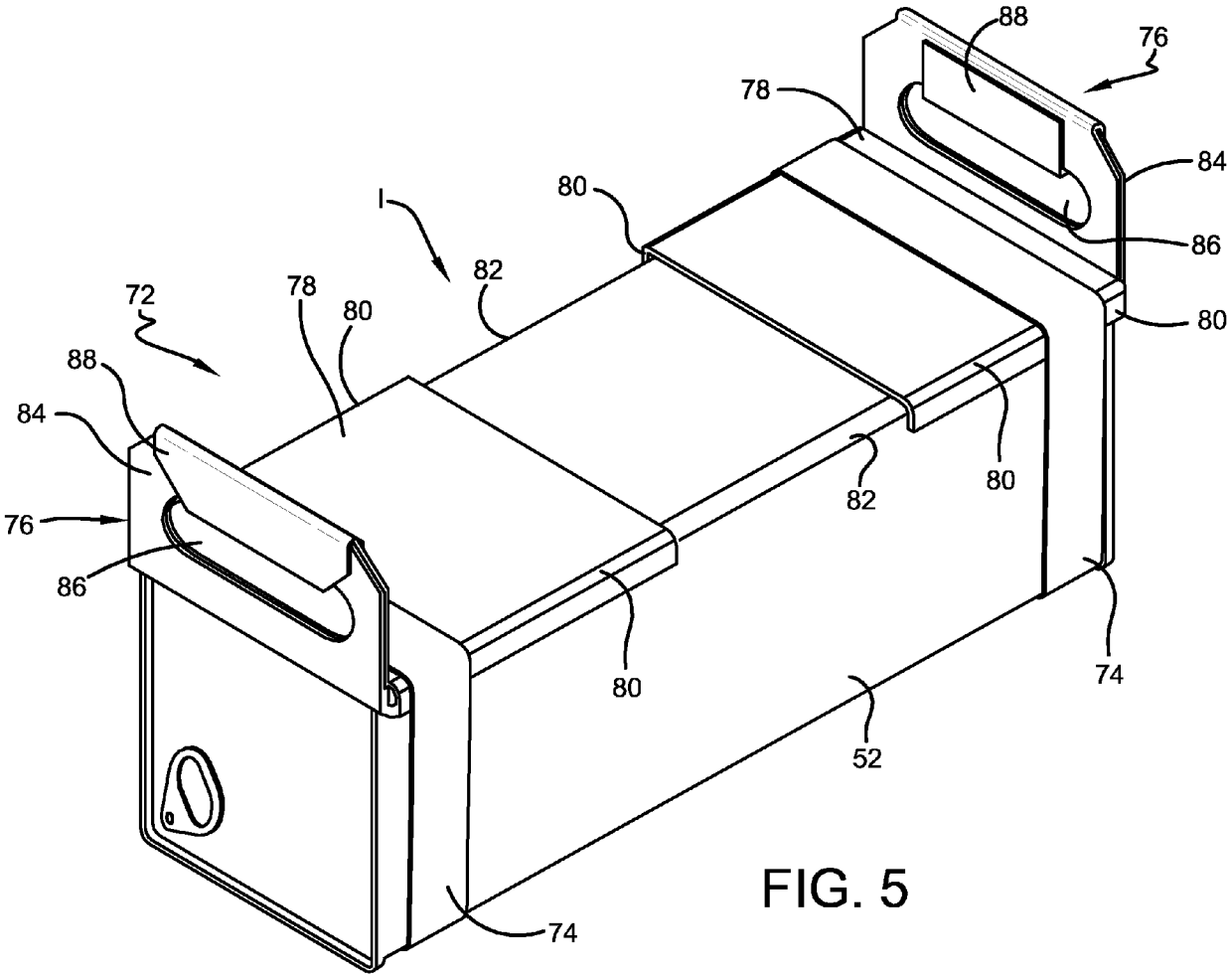
FIG. 5 is a top perspective view of an alternative carton assembly holding a container illustrating the use of banded handles.

FIG. 5 illustrates a perspective view of carton assembly 72 having securing means 74 that securedly attaches at least two handle assemblies 76 to container 52. In the illustrated embodiment, each handle assembly 76 includes a longitudinal extending top panel 78 and laterally separated sidewalls 80 that vertically extend below the horizontal plane of top panel 78. The transition between top panel 78 and sidewalls 80 provides a layer or barrier of material between securing means 74 and edges 82 of container 52. In another embodiment, top panel longitudinally and laterally extends more or less than what is illustrated in FIG. 5. In yet another embodiment, the sidewalls vertically extend downward farther than what is illustrated in FIG. 5. In the illustrated embodiment, securing means 74 is plastic packaging banding that securedly affixes each handle to container 52. The plastic packaging banding may be any width and thickness and may be reinforced to hold at least some of the weight of the carton assembly and the container. In another embodiment, the securing means is longitudinally positioned in another location than what is illustrated in FIG. 5, e.g., closer to the longitudinal ends of the container or closer to the longitudinal center of the container. In another embodiment, the securing means may include at least one of the following: tape (plastic, fibrous, and paper), steel banding, and the like. In yet another embodiment, each handle assembly may be securedly attached to the container by plastic sheeting that may be shrink wrapped around the container. In another embodiment, the securing means includes glue or adhesive that secures at least one handle assembly to the container. In yet another embodiment, more than one banding, tape, or the like securedly attaches each handle assembly to the container.

In the illustrated embodiment, each handle assembly 76 further includes a vertically extending handle 84 having aperture 86 and handle cushion member 88. Similar to the handles discussed above, each vertically and upwardly extending handle 84 tilts away from the ends of container 52 and carton assembly 72. As discussed above, each vertically extending handle 84 may be at an angle relative to a vertical plane (not shown) ranging from between zero and sixty degrees. In another embodiment, the handle can form an angle beginning at any point above the bottom of the end panel. In the illustrated embodiment, vertically extending handles 84 and top panels 78 on each end of container 52 form an index I, locator, or nest that releasably receives or engages bottom panel (not shown) of another carton and/or container that may be stacked on top of container 52 and carton assembly 72. In another embodiment, at least one handle assembly is securedly attached to a sidewall of the carton or another portion of the carton. As discussed below, handle assemblies of other configurations are also contemplated within the scope of this invention.

Figure 6:
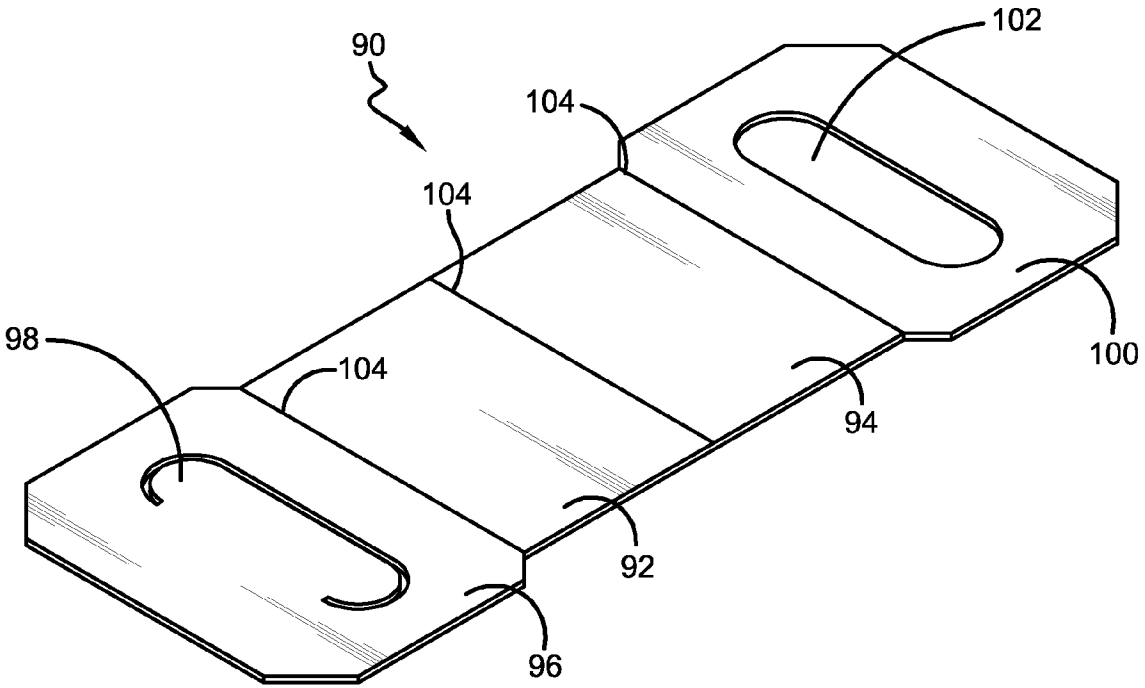
FIG. 6 is a top perspective view of a single handle flat that can be used to hold at least a portion of the container illustrated in FIG. 5.

FIG. 6 illustrates handle assembly flat or blank 90 that can be formed and used in place of the handle assembly discussed above in FIG. 5. Handle assembly blank 90 is shown as a generally planar and contiguous piece of material that includes a plurality of panels that are scored and configured to form a handle assembly, as further discussed below. Handle assembly blank 90 may be made from fibrous materials, e.g., cardboard and other paper materials, polymer substances, or both fibrous and polymer materials. Handle assembly blank 90 includes first top panel 92, second top panel 94, first handle panel 96 with cutout 98, and second handle panel 100 with aperture 102. In another embodiment, the handle assembly blank includes more or less panels than what is illustrated in FIG. 6, e.g., each top panel includes two panels. In yet another embodiment, handle panels may both include at least one aperture. In the illustrated embodiment, handle assembly blank 90 includes a plurality of pleats 104 or scores that facilitate forming the alternative handle assembly, discussed further below. In another embodiment, handle assembly blank may include at least one fastening means that includes tape, glue, banding, and/or at least one fastener known by one skilled in the art.

Figure 7A:
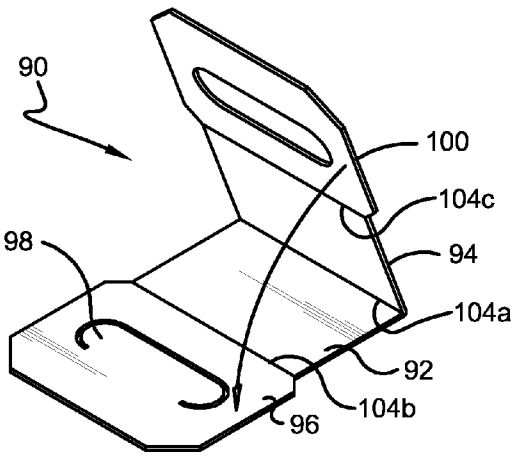
FIGS. 7*a*-7*f* are top perspective views of the handle flat illustrated in FIG. 6 shown being folded.
Figure 7B:
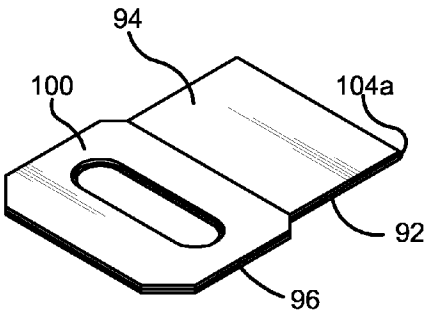
Figure 7C:
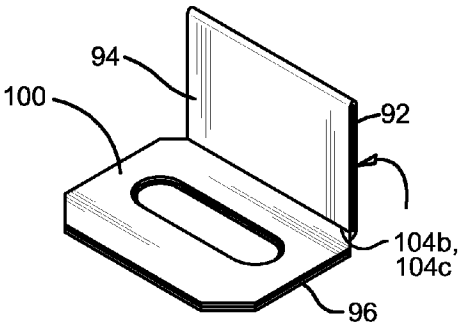
Figure 7D:
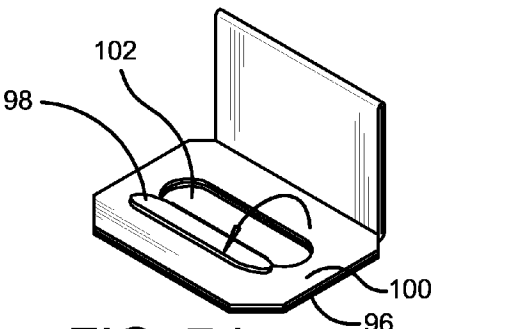
Figure 7E:
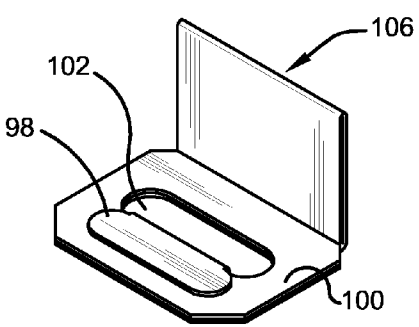
Figure 7F:
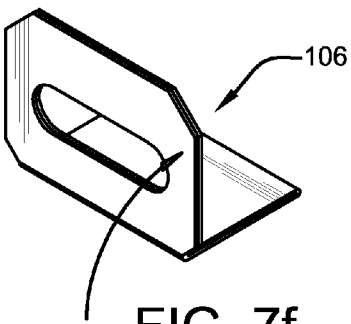

FIGS. 7*a*-7*f* illustrate the transformation of a handle assembly blank into an alternative handle assembly that can be used in place of the handle assembly discussed above in FIG. 5. In FIGS. 7*a*-7*b*, second top panel 94 and second handle panel 100 fold along first pleat 104*a* onto first top panel 92 and first handle panel 96. FIG. 7*c* illustrates first top panel 92 and second top panel 94 folding along second pleat 104*b* and third pleat 104*c* so that the top panels and the handle panels are arranged to form approximately a right angle handle assembly. In another embodiment, the panels can be configured to form another angle, e.g., an angle more than ninety degrees so the handle assemblies can form a stacking index once the assemblies are securedly fastened to a container (as discussed above). In FIGS. 7*d*-7*e*, cutout 98 from first handle panel 96 is illustrated as being moved through aperture 102, securedly interlocking first handle panel 96 and second handle panel 100. In another embodiment, the handles are securedly interlocked or attached with a tape, adhesive, and/or a fastener known to one skilled in the art. FIGS. 7*e*-7*f* illustrate positioning alternative handle assembly 106 in an upright position in preparation of securedly attaching handle assembly 106 to a container as discussed above. In another embodiment, handle assembly may include at least one of the following fastening means including tape, glue, banding, stapling, Velcro, adhesive (permanent, removable, or pressure-sensitive) and/or at least one fastener known by one skilled in the art.

Figure 8:
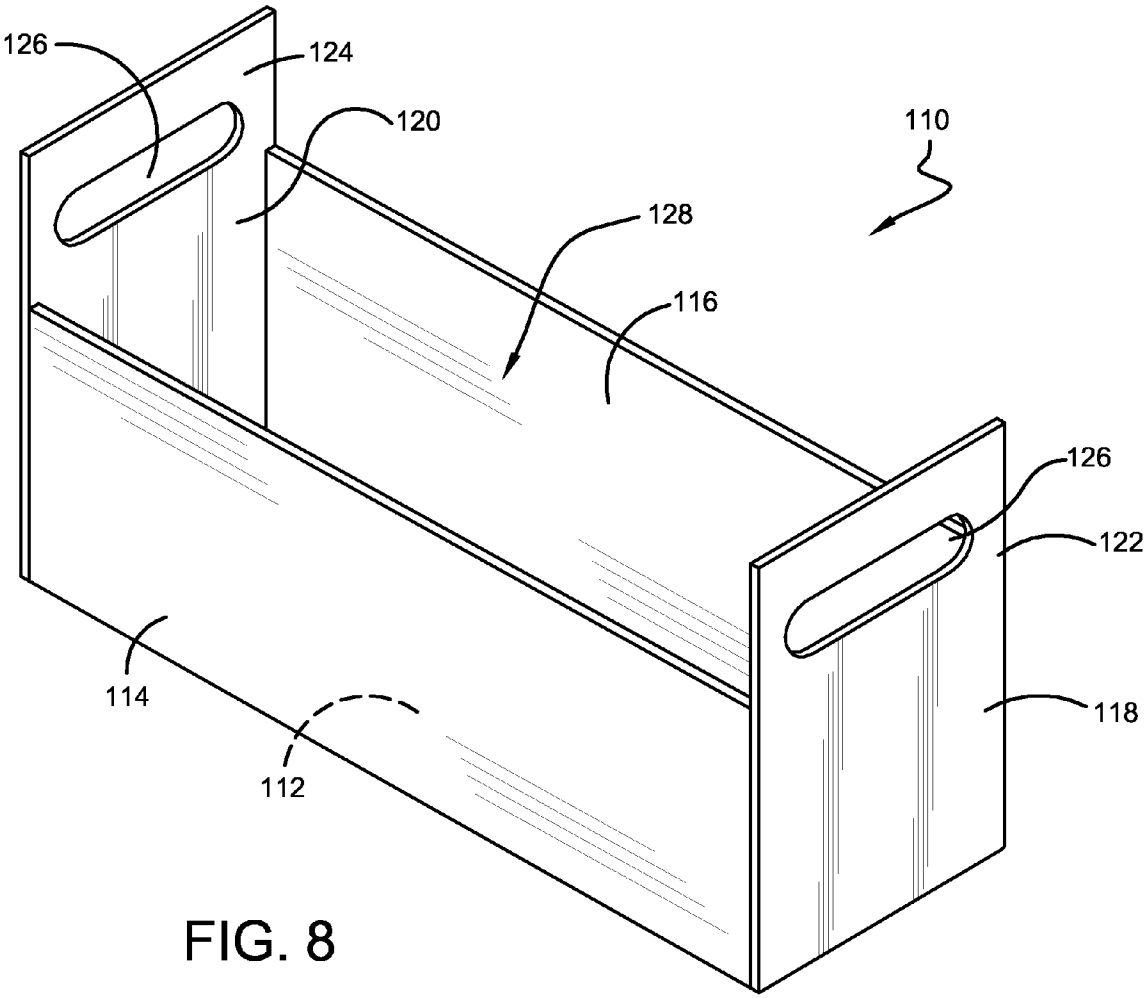
FIG. 8 is a top perspective view of a carton configured to hold the container illustrated in FIG. 5.

FIG. 8 illustrates a top perspective view of an alternative carton 110 that is similar to carton 20 discussed above, including materials and position of the handles relative to a container (not shown) and/or the top or side panels of the carton, except carton 110 does not include a top panel. In the illustrated embodiment, carton 110 includes bottom panel 112, sidewall panels 114 and 116, end panels 118 and 120, and handles 122 and 124 each having an aperture 126. End panels 118 and 120 vertically extend to form handles 122 and 124. In addition, carton 110 has an open top section or aperture 128 so a top portion of a container (not shown) can be visibly seen in the carton. As discussed above, handles 122 and 124 may be tilted away from the longitudinal center (not shown) of carton 110 for stacking purposes and handles 122 and 124 may extend from other panels of the carton in other embodiments. In another embodiment, a container may be securedly packaged by a fastening means that may include at least one of the following: tape (paper, fibrous, or plastic), plastic banding, steel banding, and the like, wherein the fastening means securedly attaches to at least two panels, e.g., the side panels and the bottom panel and across the aperture on the top of the carton. In another embodiment, the container may be securedly packaged in the carton by plastic sheeting that may be shrink wrapped around the container. In another embodiment, more than one banding, tape, and the like securedly packages the container in the carton. In yet another embodiment, the alternative carton may optionally include manufacturers glue tabs to securedly fasten at least the end panels, sidewall panels, and bottom panel in the folded position, wherein said glue tabs may be internally or externally positioned. In another embodiment, the alternative carton may optionally include extended glue tabs and the like to retain the carton in a tray or box-like shape. In yet another embodiment, the alternative carton may include handle reinforcements as illustrated previously in FIGS. 1*a*-5.

Figure 9:
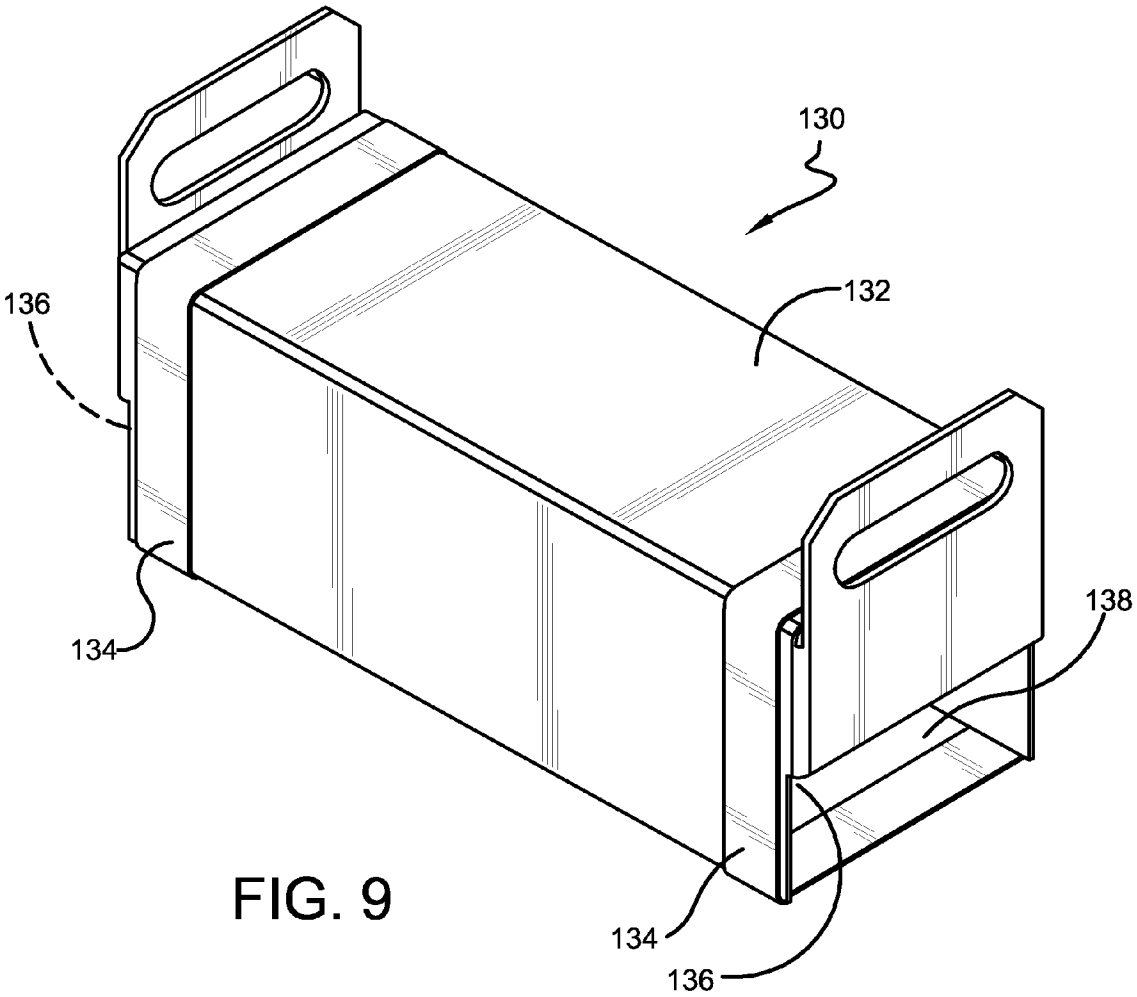
FIG. 9 is a top perspective view of a carton configured to hold the container illustrated in FIG. 5.

FIG. 9 illustrates a perspective view of an alternative carton 130 that is similar to the carton 110 discussed above, including materials and position of the handles relative to a container (not shown) and/or the top or side panels of the carton, except carton 130 includes top panel 132, further includes a securing means 134, and has open ends 136 and open bottom 138 so ends and bottom of a container (not shown) can be visibly seen in carton 130. In the illustrated embodiment, securing means 134 is plastic packaging banding that securedly attaches carton 130 to a container (not shown). The plastic packaging banding may be reinforced and is configured so that each band holds at least half of the weight of the carton and container. In another embodiment, securing means is longitudinally positioned in other longitudinal locations than what is illustrated in FIG. 9. In another embodiment, securing means may include at least one of the following: tape (paper or plastic), plastic banding, steel banding, and the like. In yet another embodiment, the carton may be securedly attached to the container by plastic sheeting that may be shrink wrapped around the container. In another embodiment, more than two packaging bandings, tape, and the like securedly attach each handle assembly to the container. In another embodiment, the carton includes more or less panels than what is illustrated in FIG. 9. In yet another embodiment, the carton includes a cutout in at least one panel so another portion of the container can be seen by an end-user.

Figure 10:
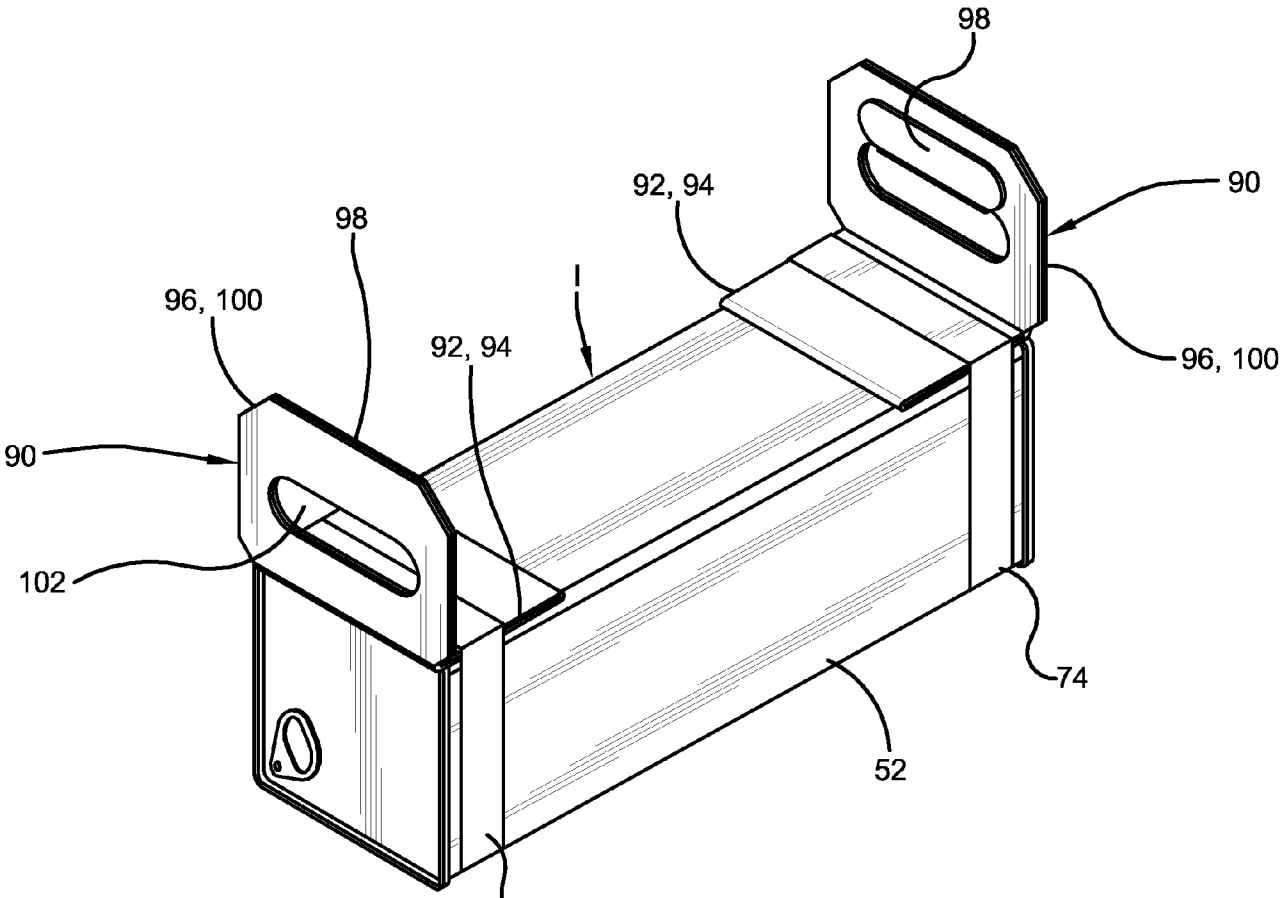
FIG. 10 is a top perspective view of the handle illustrated in FIG. 7*f* holding a container.

FIG. 10 illustrates a top perspective view of two handles 90 (discussed above and further illustrated in FIG. 6 and FIG. 7*f*) attached to container 52. In the illustrated embodiment, each handle 90 is securedly affixed to container 52 by securing first top panel 92 and second top panel 94 to container 52 by securing means 74, e.g., plastic packaging banding securedly affixes first top panel 92 and second top panel 94 of each handle 90 to container 52. The plastic packaging banding may be any width and thickness and may be reinforced to hold at least half of the weight of the handles and the container. In another embodiment, the securing means is longitudinally positioned in another location, other than what is illustrated in FIG. 10, e.g., closer to the longitudinal ends of the container or closer to the longitudinal center of the container. In another embodiment, the securing means may include at least one of the following: tape (plastic and paper), steel banding, and the like. In yet another embodiment, each handle may be securedly attached to the container by plastic sheeting that may be shrink wrapped around the container. In another embodiment, the securing means includes glue or adhesive that secures at least one handle to the container. In yet another embodiment, more than one banding, tape, or the like securedly attaches each handle to the container. In another embodiment, the handle may include downward extending sidewall or another panel to provide cushioning between the securing means and the container.

In the illustrated embodiment, each handle 90 further includes first handle panel 96 with cutout 98 and second handle panel 100 with aperture 102 that vertically extend above the horizontal plane of the top of container 52. Each vertically and upwardly extending handle 90 tilts away or pivotally offsets from the ends of container 52. As discussed above, each vertically extending handle 90 may be at an angle relative to a vertical plane (not shown) ranging from between zero and sixty degrees. In the illustrated embodiment, vertically extending first handle panel 96 with cutout 98 and second handle panel 100 with aperture 102 and top panels 92, 94 on each end of container 52 form an index I, locator, or nest that releasably receives or engages bottom panel (not shown) of another carton and/or container that may be stacked on top of container 52 and first top panels 92 and second top panels 94 of handles 90. In another embodiment, at least one handle assembly is securedly attached to a sidewall of the carton or another portion of the carton. Handle assemblies of other configurations are also contemplated within the scope of this invention.

Figure 11:
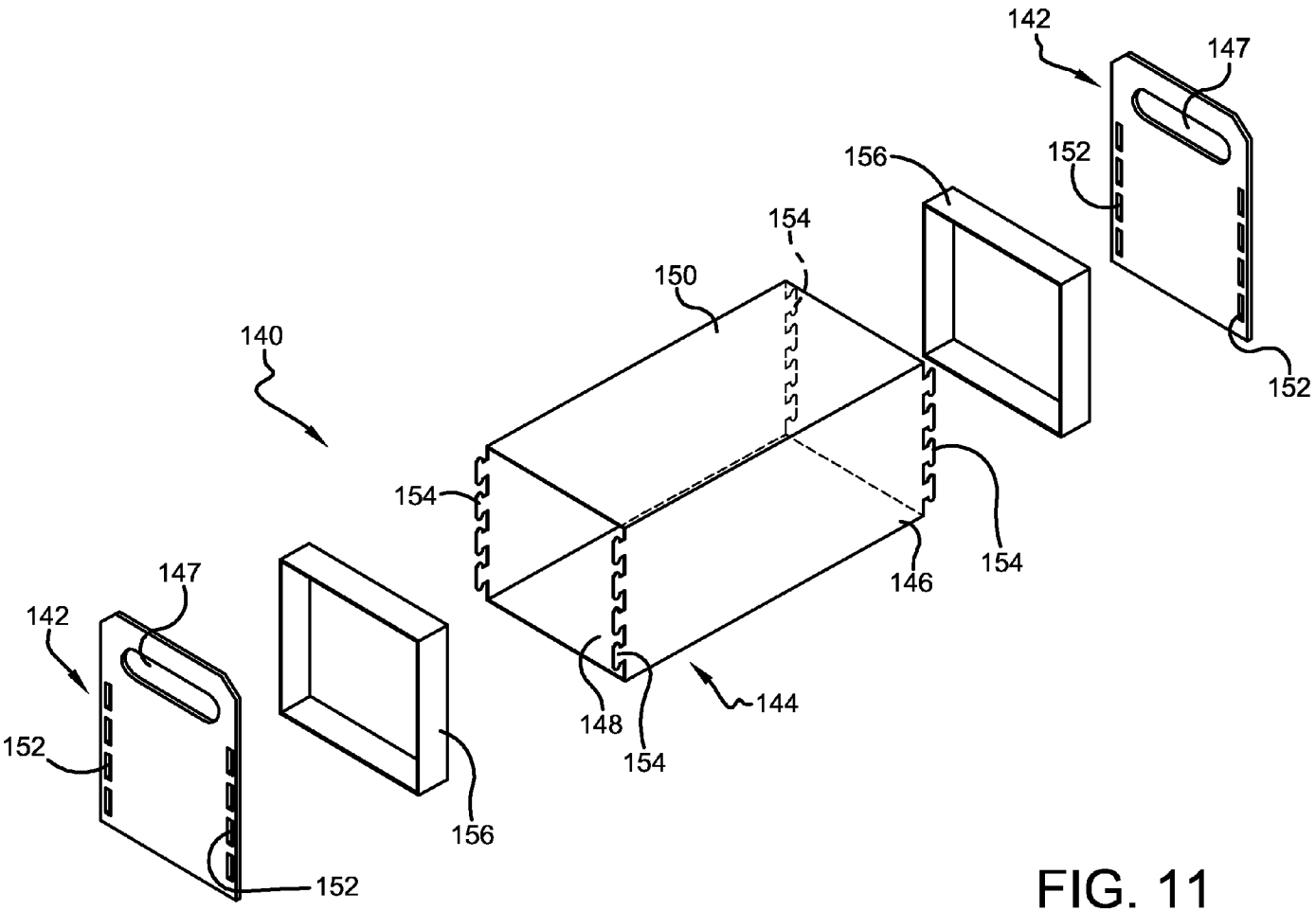
FIG. 11 is an exploded alternative carton assembly having handles fashioned to matingly engage with carton sidewalls.

FIG. 11 illustrates an exploded view of an alternative carton assembly 140 having handles 142 configured to slideably engage with carton walls 144. In the illustrated embodiment, carton walls 144 include sidewalls 146, bottom panel 148, and top panel 150. In another embodiment, the carton walls may optionally include at least one sidewall, a bottom panel, and/or at least one top panel. In the illustrated embodiment, carton assembly 140 includes handles 142 that have four receiving slots 152 on each lateral side that slideably receive and engage with longitudinally extending tabs 154 fashioned on both longitudinal ends of sidewalls 146. In the illustrated embodiment, four receiving slots 152 on each lateral side of handle 142 receive and support tabs 154 of carton walls 144 that hold a container (not shown). Tabs 154 may optionally be folded to further secure carton assembly 140. In another embodiment, the sidewalls can have a number of longitudinally extending tabs and the handles can have a number of slots that are different than what is illustrated in FIG. 11. In yet another embodiment, the sidewalls can have tabs and the handles can have slots that are different in design that what is illustrated in FIG. 11 so an end-user can carry and/or stack the carton assembly holding a container. In the illustrated embodiment, handles 142 include apertures 147 that are vertically above an upper horizontal plane of carton walls 144 and upper portions of handles 142 can tilt away from ends of carton assembly 140 as illustrated previously in FIGS. 3*a*-3*b*. In the illustrated embodiment, carton assembly 140 optionally includes securing means 156 that provides additional support to carton assembly 140. In another embodiment, at least one of the handles may include a tab and at least one end of the sidewall may include a slot. In yet another embodiment, the alternative carton assembly may include handle reinforcements as illustrated previously in FIGS. 1*a*-5. In other words, the alternative carton assembly includes a pair of spaced-apart vertical carton sides, an optional top carton side and a bottom carton side connecting the sides, each vertical side having at least one laterally-extending tab on each end of the vertical sides. Further, the carton assembly includes a pair of handles on each end of the spaced-apart vertical sides, each handle having a pair of essentially parallel sides, a top and a bottom side, each of the vertical sides having at least one slot positioned inward from the vertical side and in mating alignment with the at least one laterally-extending tab.

In the illustrated embodiment, securing means 156 is plastic packaging banding that securedly affixes the carton walls and/or each handle to a container (not shown). The plastic packaging banding is substantially similar to the plastic packaging banding discussed above. In another embodiment, the handles and carton sidewall may have another male/female, tab/slot, or lock/key configuration that is fashioned so the handles can be quickly and easily slideably and/or securedly connected with the carton walls that contain at least a portion of a container.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments disclosed, but that the invention will include all embodiments falling within the scope of the appended claims

What is claimed is:

1. In combination, a carton and a container disposed within said carton comprising:

a plurality of items in said container, wherein said plurality of items longitudinally extend in said container; and a pair of side carton walls spaced apart by at least one bottom carton wall, each of said side carton walls having a pair of inwardly bendable lateral flaps to form a pair of end walls, and a pair of top walls foldable upon each other, each of said top walls having a laterally extending edge, and at least two handles extending above a horizontal plane from said pair of top walls of said container, each of said at least two handles extending upwardly from laterally extending edges of said top walls of said end walls, wherein said handles vertically extend from opposing ends of said carton from each of said top walls, wherein said handles include apertures in said vertically extending handles and said apertures are above said horizontal plane, wherein said handles and said at least one carton wall form an offset stacking index, and wherein said horizontal plane is a top panel;

wherein said carton includes end panels on each longitudinal end formed by said inwardly bendable lateral flaps of said side carton walls, and wherein each end panel of said carton covers a first upper portion on each end of said container so a second lower portion on each end of said end of said container is outwardly exposed; and wherein each of said laterally extending edges pair of said top carton walls include an aperture, and wherein said aperture is positioned within each of said at least two handles extending upwardly from said laterally extending edges of said top walls of said end walls.

2. The combination of claim 1, wherein said plurality of items are electrodes.

3. The combination of claim 1, wherein a first handle is pivotally outwardly offset at a first angle relative to a first end of said container and wherein a second handle is pivotally outwardly offset at a second angle relative to a second end of said container.

4. The combination of claim 3, wherein said first angle and said second angle range between zero and sixty degrees.

5. The combination of claim 4, wherein said first angle and said second angle are unequal.

6. The combination of claim 1, wherein each of said handles has an aperture disposed therein;

said aperture including handle reinforcements.

7. The combination of claim 6, wherein said handle reinforcements are said pair of laterally extending top walls which extend upwardly from said end walls.

8. The combination of claim 7, wherein said handle reinforcements are a portion of said laterally extending top walls which are folded into said apertures of each of said handles.

9. The combination of claim 1, wherein said handles includes a first handle and a second handle, and wherein at least one of said first handle and said second handle tilt outwardly away from an adjacent end of said container.

10. In combination, a carton and a container disposed within said carton comprising:

a plurality of items in said container, wherein said plurality of items longitudinally extend in said container; and a pair of side carton walls spaced apart by at least one bottom carton wall, each of said side carton walls having a pair of inwardly bendable lateral flaps to form a pair of end walls, and a pair of top walls foldable upon each other, each of said top walls having a laterally extending edge, and at least two handles extending above a horizontal plane from said pair of top walls of said container, each of said at least two handles extending upwardly from laterally extending edges of said top walls of said end walls, wherein said handles vertically extend from opposing ends of said carton from each of said top walls, wherein said handles include apertures in said vertically extending handles and said apertures are above said horizontal plane, wherein said handles and said at least one carton wall form an offset stacking index, and wherein said horizontal plane is a top panel;

wherein said carton includes end panels on each longitudinal end formed by said inwardly bendable lateral flaps of said side carton walls, and wherein each end panel of said carton covers a first upper portion on each end of said container so a second lower portion on each end of said end of said container is outwardly exposed; and wherein each of said laterally extending edges pair of said top carton walls include an aperture, and wherein said aperture is positioned within each of said at least two handles extending upwardly from said laterally extending edges of said top walls of said end walls;

wherein each of said handles has an aperture disposed therein; said aperture including handle reinforcements; wherein said handle reinforcements are said pair of laterally extending top walls which extend upwardly from said end walls.

11. The combination of claim 10, wherein said handle reinforcements are a portion of said laterally extending top walls which are folded into said aperture of each of said handles.

* * * * *